US009622639B2

(12) United States Patent
Zhu

(10) Patent No.: US 9,622,639 B2
(45) Date of Patent: Apr. 18, 2017

(54) MOP-WASHING APPARATUSES AND METHODS

(71) Applicant: Jiaxing Jackson Travel Products Co., Ltd., Jiaxing (CN)

(72) Inventor: Xuelin Zhu, Jiaxing (CN)

(73) Assignee: JIAXING JACKSON TRAVEL PRODUCTS CO., LTD., Jiaxing (CN)

( * ) Notice: Subject to any disclaimer, the term of this patent is extended or adjusted under 35 U.S.C. 154(b) by 300 days.

(21) Appl. No.: 14/388,183

(22) PCT Filed: Sep. 10, 2014

(86) PCT No.: PCT/CN2014/086179
§ 371 (c)(1),
(2) Date: Sep. 25, 2014

(87) PCT Pub. No.: WO2015/074452
PCT Pub. Date: May 28, 2015

(65) Prior Publication Data

US 2016/0128542 A1 May 12, 2016

(30) Foreign Application Priority Data

Nov. 21, 2013 (CN) ..... 2013 2 0738397 U

(51) Int. Cl.
*A47L 13/58* (2006.01)

(52) U.S. Cl.
CPC ..... *A47L 13/58* (2013.01)

(58) Field of Classification Search
CPC ..... A47L 13/50; A47L 13/502; A47L 13/58; Y10S 15/09
(Continued)

(56) References Cited

U.S. PATENT DOCUMENTS 5,361,448 A * 11/1994 Chao ..... A47L 13/58 15/263
2010/0287724 A1 11/2010 Hsu

FOREIGN PATENT DOCUMENTS

CN 103070653 5/2013
CN 202920105 5/2013
(Continued)

OTHER PUBLICATIONS

ISA/CN, International Search Report and Written Opinion for International Application No. PCT/CN2014/086179, Nov. 21, 2014, 4 pages.

*Primary Examiner* — Mark Spisich
(74) *Attorney, Agent, or Firm* — Fish & Tsang, LLP

(57) ABSTRACT

A mop-cleaning bucket includes an extensible post connected to an internal side of a lower portion of a bucket. The extensible post includes a stationary element and a movable element. The extensible post further includes at least one track and at least one boss for connecting the stationary element to the movable element. The track includes a lower longitudinal groove in communication with an upper longitudinal groove. The movable element includes a bore made in an upper end. A lower bushing and an upper bushing are inserted in the bore. The axle is inserted in the upper bushing. The axle includes a lower end inserted in the lower bushing and an upper end for connection to a mop. The washing bucket does not include any cage so that the mop can fully contact water and that the mop can effectively be washed by the water.

12 Claims, 12 Drawing Sheets

(58) Field of Classification Search
USPC ..... 15/257.01, 260, 263, 264, DIG. 9; 34/58
See application file for complete search history.

(56) References Cited

FOREIGN PATENT DOCUMENTS

| | | |
|---|---|---|
| CN | 203182862 | 9/2013 |
| CN | 203619505 | 6/2014 |
| CN | 203724053 | 7/2014 |

* cited by examiner

MOP-WASHING APPARATUSES AND METHODS

CROSS REFERENCE TO RELATED APPLICATION

The present invention is a national phase entry of PCT/CN2014/086179, filed on Sep. 10, 2014, which claims priority to CN 201320738397.5, filed on Nov. 21, 2013, the specifications of which are hereby incorporated in their entirety by reference.

BACKGROUND OF INVENTION

1. Field of Invention

The present invention relates to a washing apparatus and, more particularly, to a mop-washing bucket equipped with an extensible post.

2. Related Prior Art

A conventional mop-washing bucket includes a washing unit and a spin-drying unit arranged side by side. This mop-washing bucket is however bulky such as disclosed in Chinese Patent CN201330360846.2. The problem of bulkiness has been solved by an elevation-type washing and spin-drying bucket apparatus that includes a bucket and a cage such as disclosed in Chinese Patent CN201320013544.2. The cage is coaxially connected to a stand or extensible post that is movable up and down on an internal side of the bucket. Thus, a mop head is located higher than the bucket and ready to be spin-dried when the cage is lifted with the stand or elevating axle. The mop head is located lower than the level of water contained in the bucket and ready to be washed when the cage is lowered with the stand or elevating axle. The mop head cannot however be fully extended to completely wash away mud and/or sand from the mop head because of the cage. Moreover, the cage is connected to the stand or extensible post via a bearing that cannot be sealed. The mud and/or sand enter, rust and wear away the bearing, thus jeopardizing the life of the elevation-type washing and spin-drying bucket apparatus.

The present invention is therefore intended to obviate or at least alleviate the problems encountered in prior art.

SUMMARY OF INVENTION

It is the primary objective of the present invention to provide a mop-cleaning apparatus to solve the problem of inadequate washing of a mop related to the use of a cage and the problem of wearing away a bearing used in such a cage.

To achieve the foregoing objective, the mop-cleaning apparatus includes an extensible post connected to an internal side of a lower portion of a bucket. The extensible post includes a stationary element, a movable element movably connected to the stationary element, at least one track arranged between the stationary element and the movable element, at least one boss movably inserted in the track, and an axle connected to an upper end of the movable element. The track includes a lower longitudinal groove and an upper longitudinal groove in communication with the lower longitudinal grove. The axle includes an upper end for connection to a mop.

In another aspect, the movable element includes a bore made in the upper end thereof, a lower bushing inserted in the bore, and an upper bushing inserted in the bore. The axle is inserted in the upper and lower bushings.

In another aspect, the stationary element is a tubular element, the track is made in an internal side of the stationary element, the boss is formed on an external side of a lower portion of the movable element, and the movable element is inserted in the stationary element.

In another aspect, the movable element is a tubular element, the track is located on an external side of the stationary element, the boss is located on an internal side of a lower portion of the movable element, and the stationary element is inserted in the movable element.

In another aspect, the movable element is a tubular element, the track is located on an internal side of the movable element, the boss is located on an external side of an upper portion of the stationary element, and the stationary element is inserted in the movable element.

In another aspect, the track further includes an annular groove for connecting the lower longitudinal groove to the upper longitudinal groove, and each of the lower and upper longitudinal grooves includes a slope formed at an upper end.

In another aspect, the track further includes an upward groove, a downward groove, a first turning groove and a second turning groove. The upward groove includes a lower end connected to an upper end of the lower longitudinal groove, the downward groove includes a lower end connected to the upper end of the lower longitudinal groove, the first turning groove includes an end connected to an upper end of the upward groove and another end connected to an upper end of the upper longitudinal groove, and the second turning groove includes an end connected to an upper end of the downward groove and another end connected to the upper end of the upper longitudinal groove.

In another aspect, the track further includes an upward groove, a downward groove, a first turning groove and a second turning groove. The downward groove includes an upper end connected to a lower end of the upper longitudinal groove, the upward groove includes an upper end connected to the lower end of the upper longitudinal groove, the first turning groove includes an end connected to a lower end of the upward groove and another end connected to a lower end of the lower longitudinal groove, and the second turning groove includes an end connected to a lower end of the downward groove and another end connected to the lower end of the upper longitudinal groove.

In another aspect, the track further includes a port connected to the upper end of the downward groove.

In another aspect, the track includes several lower longitudinal grooves and an identical number of upper longitudinal grooves, there are several bosses, and the number of the lower longitudinal grooves is a multiple of the number of the bosses.

In another aspect, the mop includes a mop head made with a cavity and claws for connection to the axle.

The mop-cleaning apparatus of the present invention exhibits several advantages. Firstly, it allows the mop to be in full contact with and effectively washed by water because it does not include any cage. Secondly, it protects the axle and the bushings from mud and/or sand that would otherwise rust and wear away the axle and the bushings because the gap between the axle and the upper or lower bushing is sealed.

Other objectives, advantages and features of the present invention will be apparent from the following description referring to the attached drawings.

BRIEF DESCRIPTION OF DRAWINGS

The present invention will be described via detailed illustration of three embodiments referring to the drawings wherein.

DETAILED DESCRIPTION OF EMBODIMENTS

Figure 1:
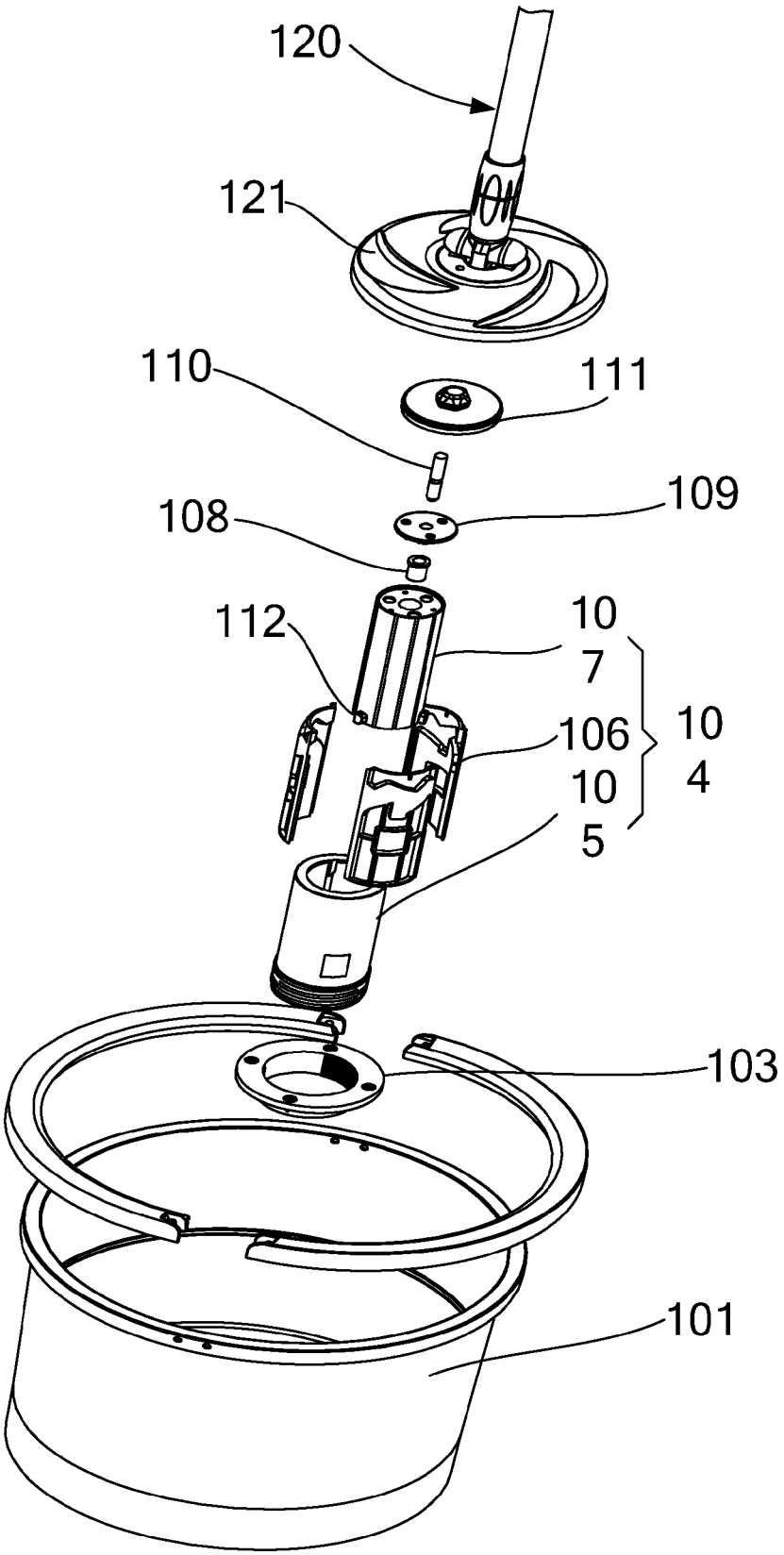
FIG. 1 is an exploded view of a mop and a mop-washing bucket equipped with an extensible post according to the first embodiment of the present invention.
Figure 2:
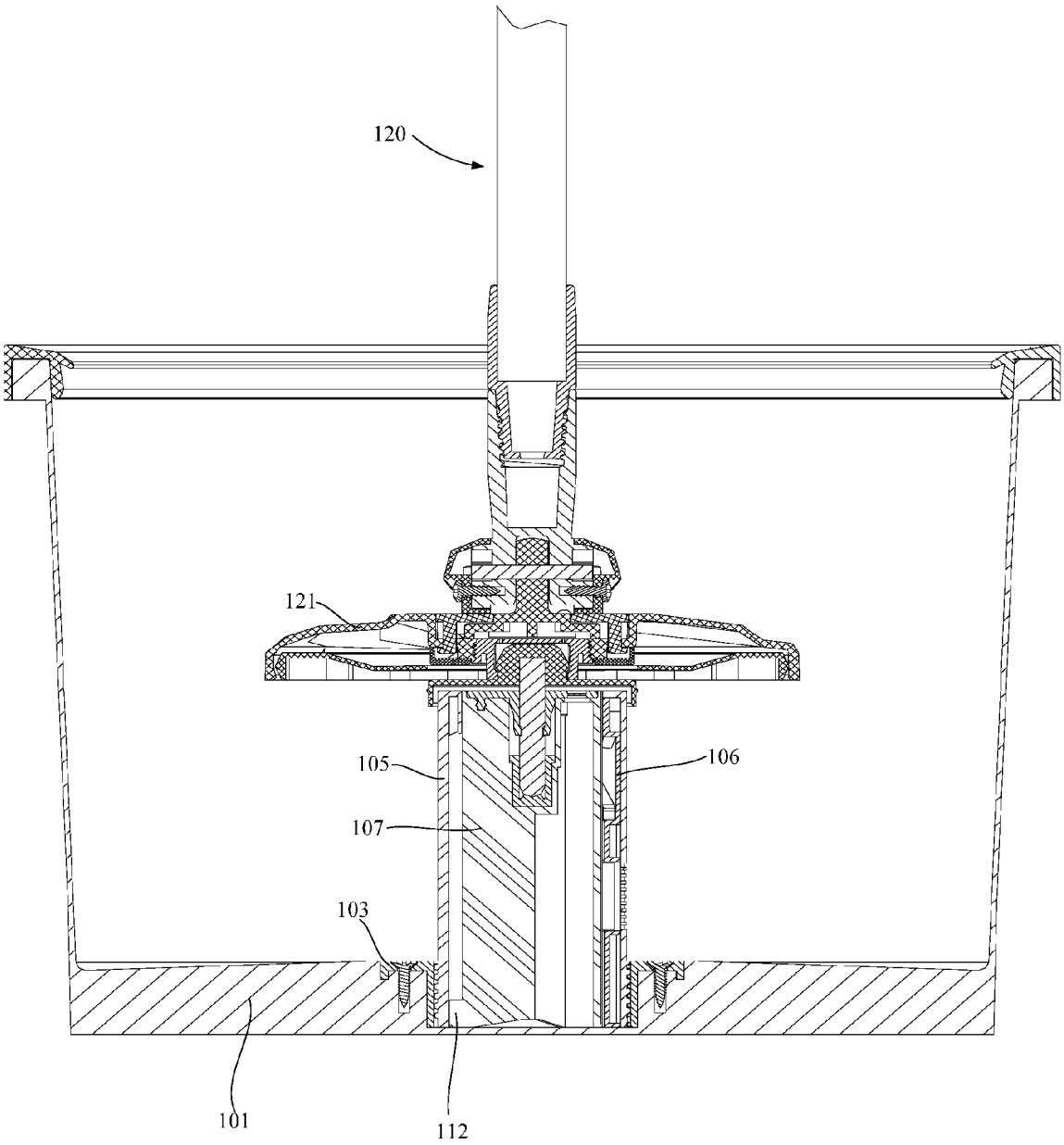
FIG. 2 is a cross-sectional view of the mop, the mop-washing bucket and the extensible post shown in FIG. 1.

Referring to FIGS. 1 and 2, there is a mop 120 and a mop-cleaning apparatus according to a first embodiment of the present invention. The mop 120 can be cleaned with the mop-cleaning apparatus. The mop-cleaning apparatus includes a bucket 101 and an extensible post 104. The bucket 101 includes a cavity in an internal side of a lower portion thereof. The cavity receives a threaded collar 103. The threaded collar 103 is secured to the lower portion of the bucket 101 via a self-tapping screw. The threaded collar 103 includes a thread formed on an internal side thereof. The threaded collar 103 receives the extensible post 104. The extensible post 104 includes a stationary element 105, three linings 106 and a movable element 107. The stationary element 105 is a tubular element that includes a thread formed on an external side of a lower portion. The thread of the stationary element 105 is engaged with the thread of the threaded collar 103. The stationary element 105 includes, on an internal side, cavities for receiving the linings 106 each including grooves. The movable element 107 is inserted in the stationary element 105. The movable element 107 includes bosses 112 formed on an external side of a lower portion. In this embodiment, the number of the bosses 112 is three, identical to the number of the linings 106. The bosses 112 are movable in the cavities of the linings 106.

Figure 3:
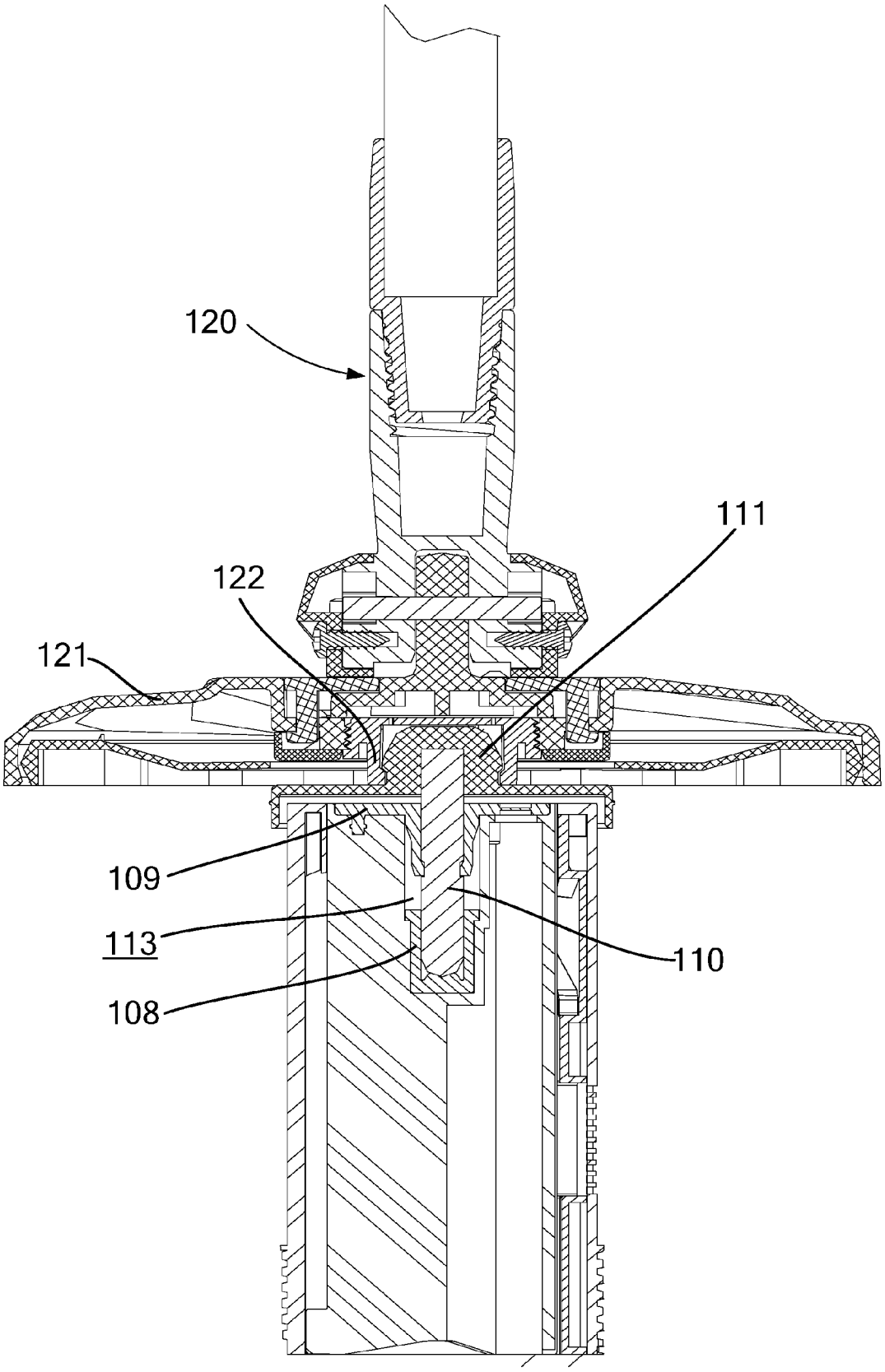
FIG. 3 is an enlarged partial view of the extensible post shown in FIG. 2.

Referring to FIGS. 1 and 3, a bore 113 is made in an upper end of the movable element 107. A lower bushing 108 is inserted in a lower portion of the bore 113. An axle 110 is inserted in a cavity made in an upper side of the lower bushing 108. An upper bushing 109 is inserted in an upper portion of the bore 113. The axle 110 includes a middle portion inserted in the upper bushing 109. The axle 110 includes a lower end inserted in the cavity of the lower bushing 108. An upper end of the axle 110 is located out of the bore 113, above the upper bushing 109. A mop head connector 111 is connected to the upper end of the axle 110 so that the mop head connector 111 is rotatable with the axle 110. In this embodiment, the axle 110 is tight in the upper bushing 109 so that the bore 113 is sealed. Thus, the axle 110 is protected from mud and/or sand that would otherwise enter the bore 113 when the mop 120 is washed.

Referring FIGS. 1 and 3, the mop 120 includes a mop head 121. A bore is made in a center of a lower side of the mop head 121. Claws 122 are formed on the wall of the bore of the mop head 121. Each of the claws 122 includes a tip formed on an internal side of a lower portion thereof. The bore of the mop head 121 of the mop 120 receives the mop head connector 111, which is conventional and will not be further described.

Figure 4:
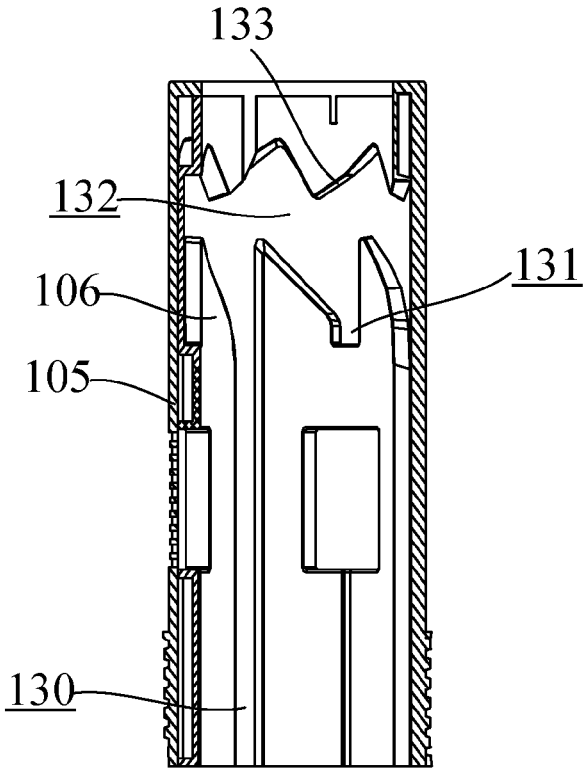
FIG. 4 is a cross-sectional view of a stationary element of the extensible post shown in FIG. 1.
Figure 5:
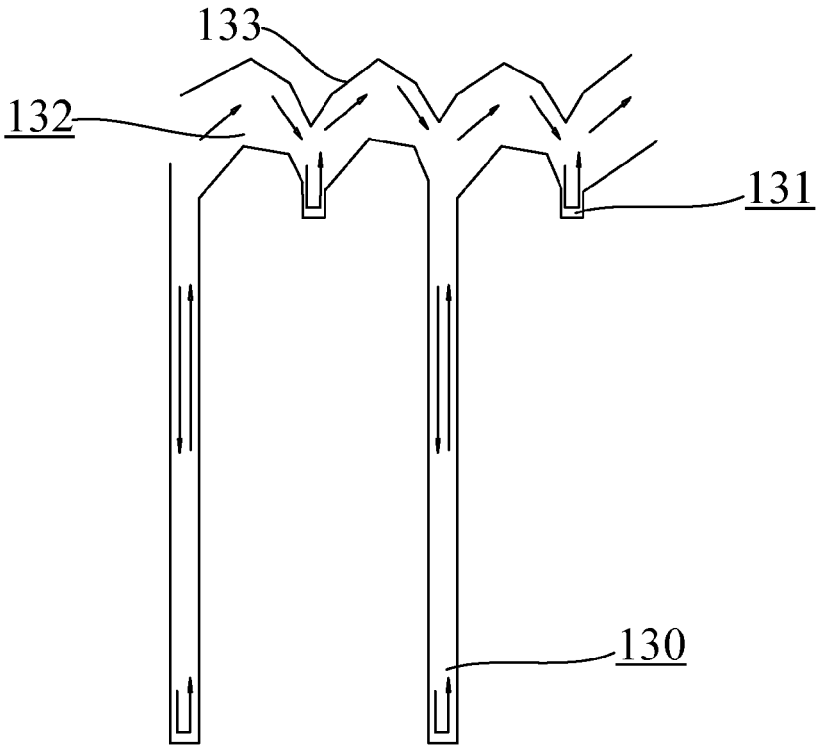
FIG. 5 is an enlarged partial view of tracks formed on an internal side of the stationary element of the extensible post of the mop-washing bucket shown in FIG. 4.

Referring to FIG. 1 and FIG. 4, the linings 106 are joined together and located against the internal side of the stationary element 105. As described above, grooves are made in the internal side of each of the linings 106. The grooves made in the internal sides of the linings 106 together become a track of the extensible post 104. Referring to FIGS. 1, 4 and 5, the track includes lower longitudinal groove 130 and upper longitudinal grooves 131. The lower longitudinal grooves 130 are connected to the upper longitudinal grooves 131 via an annular groove 132. In this embodiment, there are three lower longitudinal grooves 130 and three upper longitudinal grooves 131, and the lower longitudinal grooves 130 and the upper longitudinal grooves 131 are evenly distributed. A slope 133 is formed at an upper end of each of the lower longitudinal grooves 130 and the upper longitudinal grooves 131. When lifted out of a lower longitudinal groove 130 or upper longitudinal groove 131, each of the bosses 112 of the movable element 107 is introduced into an adjacent upper longitudinal groove 131 or lower longitudinal groove 130 by an adjacent slope 133.

Referring to FIGS. 1 and 5, when the mop-cleaning apparatus is used, the bosses 112 are movable in the track. Since the bosses 112 are rigidly connected to the external side of the lower portion of the movable element 107, the movement of the movable element 107 is guided and confined by the track. If the bosses 112 are located in the lower portions of the lower longitudinal grooves 130 originally, the bosses 112 can be lifted with the movable element 107. The movable element 107 will eventually be moved to the upper ends of the lower longitudinal grooves 130. As the movable element 107 continues to be lifted, the bosses 112 enter the annular groove 132 and reach an upper wall of the annular groove 132 and the slopes 133, which are located immediately above the lower longitudinal grooves 130. An adjacent slope 133 guides each of the bosses 112 to moves towards an adjacent upper longitudinal groove 131. If the movable element 107 is released, each of the bosses 112 will accordingly move along the annular groove 132 and then be guided by the slope 133 to fall into an adjacent upper longitudinal groove 131. If the movable element 107 is lifted again, each of the bosses 112 will enter a next lower longitudinal groove 130 in a similar manner.

Referring to FIGS. 2 and 5, to clean the mop 120, the mop head 121 is connected to the mop head connector 111, which is supported at the upper end of the movable element 107. If the bosses 112 are located in the upper longitudinal grooves 131, the mop 120 must be lifted and then lowered. In this process, the movable element 107 moves with the mop 120 and the bosses 112 move into the lower longitudinal grooves 130 in the foregoing above. Referring to FIG. 2, water is filled in the bucket 101 to fully submerge the mop head 121. The mop head 121 is washed as the mop 120 is rotated. In the bucket 101, there is no cage to contain the mop head 121. Thus, in the washing of the mop head 121, the mop head 121 is fully in contact with water and can effectively be washed.

Figure 6:
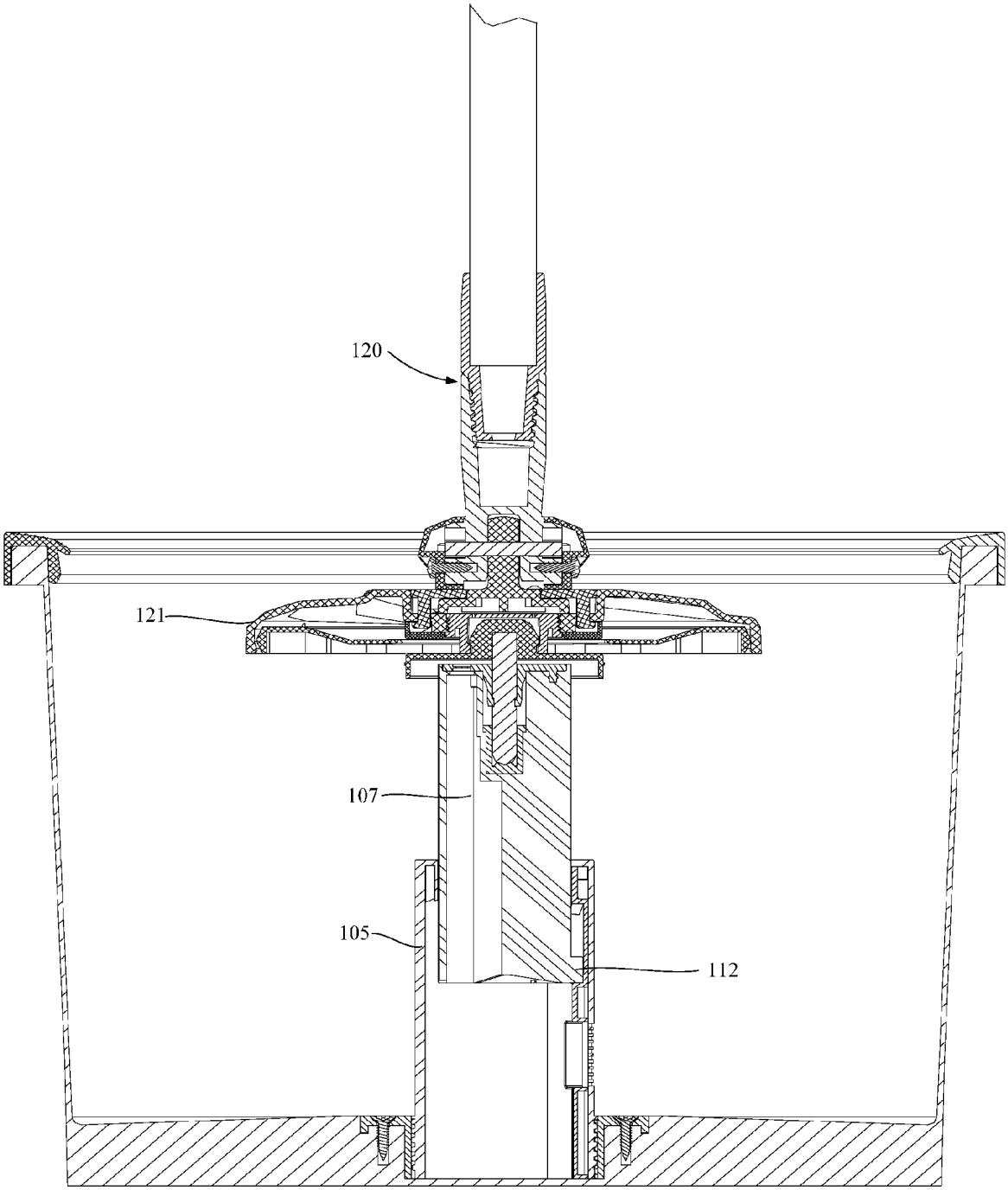
FIG. 6 is a cross-sectional view of the mop spin-dried by the mop-washing bucket equipped with the extensible post shown in FIG. 1.

Referring to FIGS. 5 and 6, the mop 120 is lifted after it is washed. Then, the mop 120 is lowered again. During the upward movement of the mop 120, the bosses 112, which are formed on the movable element 107, move into the lower longitudinal grooves 130 from the upper longitudinal grooves 131. The upper longitudinal grooves 131 are located higher than the lower longitudinal grooves 130 so that the mop head 121, which is supported at the upper end of the movable element 107, moves out of the water. Then, the mop head 121 is spin-dried as the mop 120 is spun. Then, the mop head 121 is moved from the mop head connector 111. Finally, the washing and spin-drying of the mop head 121 are finished.

Figure 7:
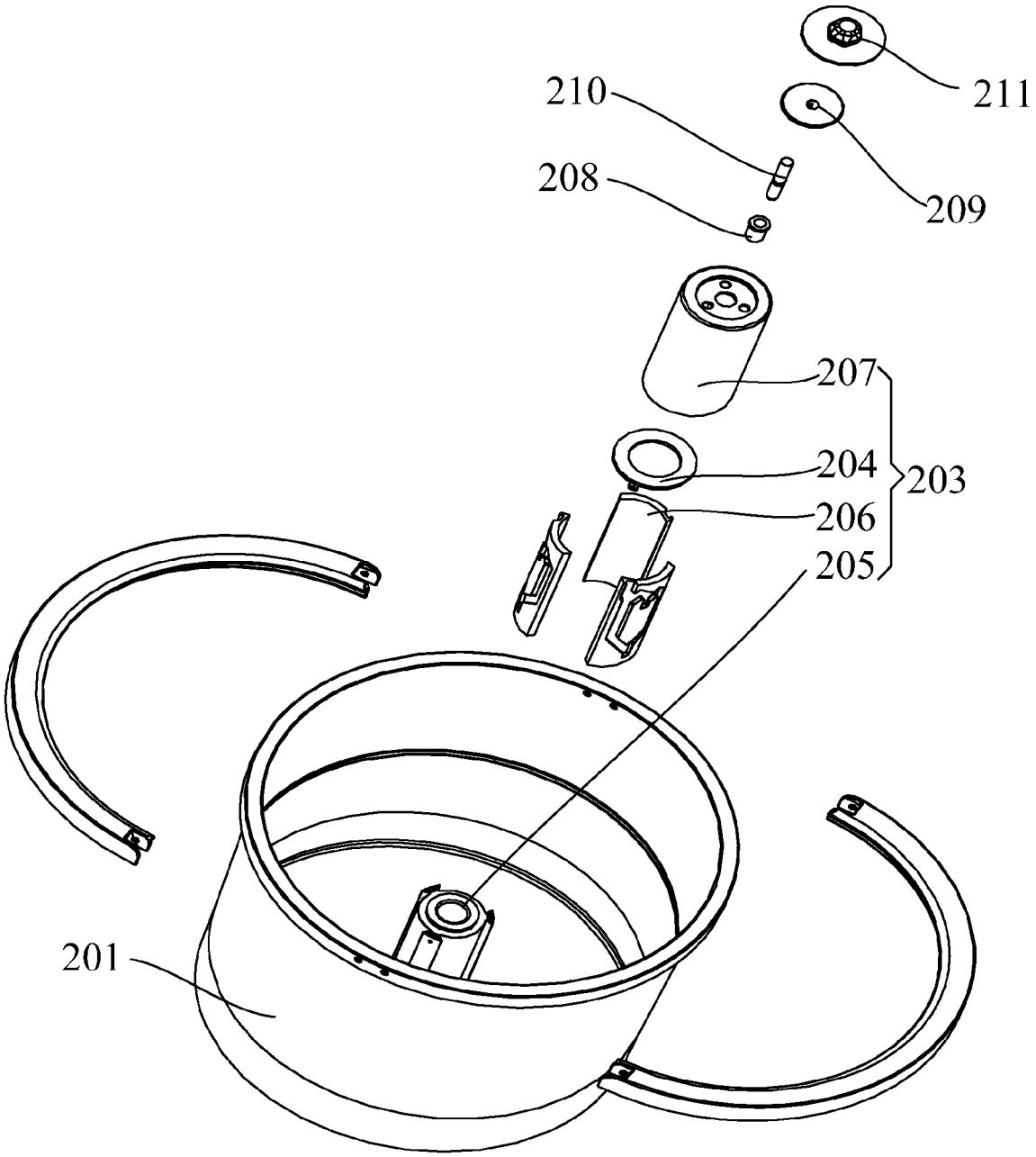
FIG. 7 is an exploded view of a mop-washing bucket equipped with an extensible post according to the second embodiment of the present invention.
Figure 8:
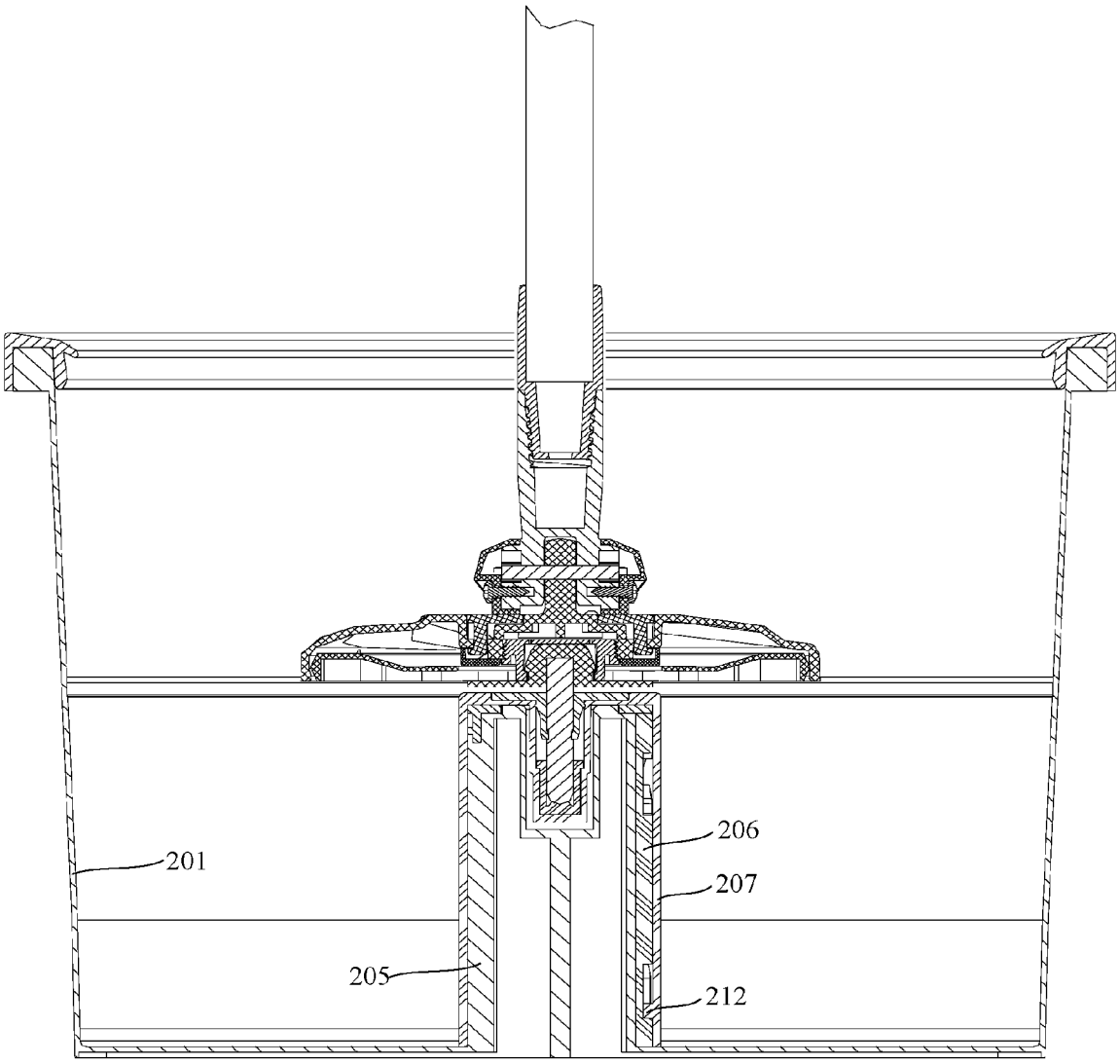
FIG. 8 is a cross-sectional view of a mop, the mop-washing bucket and the extensible post shown in FIG. 7.

Referring to FIGS. 7 to 10, there is a mop-cleaning apparatus according to a second embodiment of the present invention. Referring to FIGS. 7 and 8, the extensible post 203 includes a stationary element 205, three linings 206, an extensible post washer 204 and a movable element 207. The second embodiment is different from the first embodiment in how the movable element 207 is connected to the stationary element 205. A lower end of the stationary element 205 is secured to an internal side of a lower portion of the bucket 201. Cavities are made in the periphery of the stationary element 205. The linings 206 are inserted in the cavities of the stationary element 205. There are three the linings 206 in the second embodiment. The extensible post washer 204 is connected to an upper end of the stationary element 205. The extensible post washer 204 prevents the linings 206 from sliding in the cavities of the stationary element 205. A track is made in an internal side of each of the linings 206. The movable element 207 is a tubular element movably located on the stationary element 205. Bosses 212 are formed on an internal side of a lower portion of the movable element 207. The bosses 212 are movably inserted in the tracks of the linings 206. The bosses 212 move in the tracks made in the external sides of the linings 206 when the movable element 207 is moved up and down.

Figure 9:
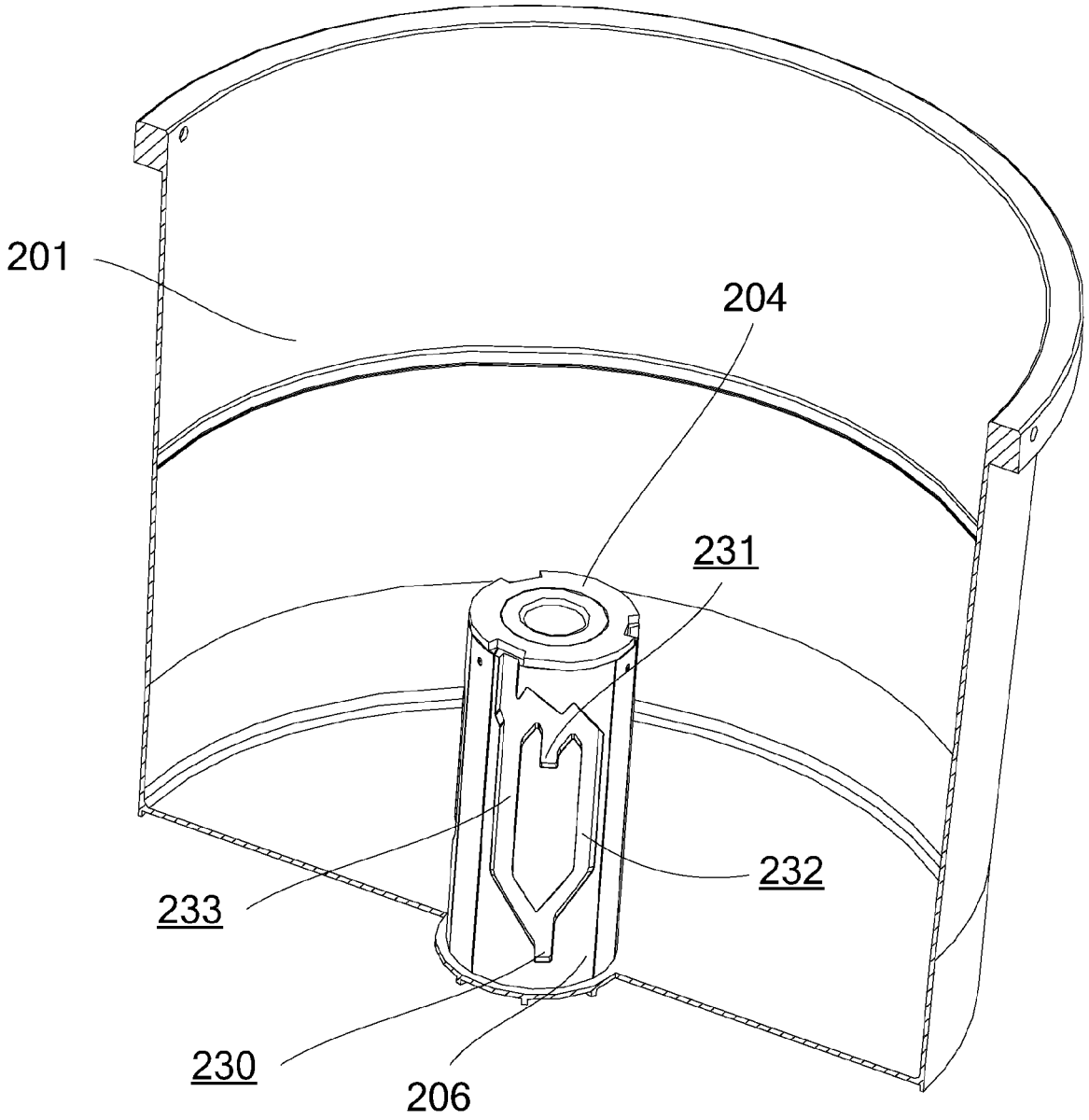
FIG. 9 is an enlarged perspective view of several linings and a stationary element of the extensible post of the mop-washing bucket shown in FIG. 8.
Figure 10:
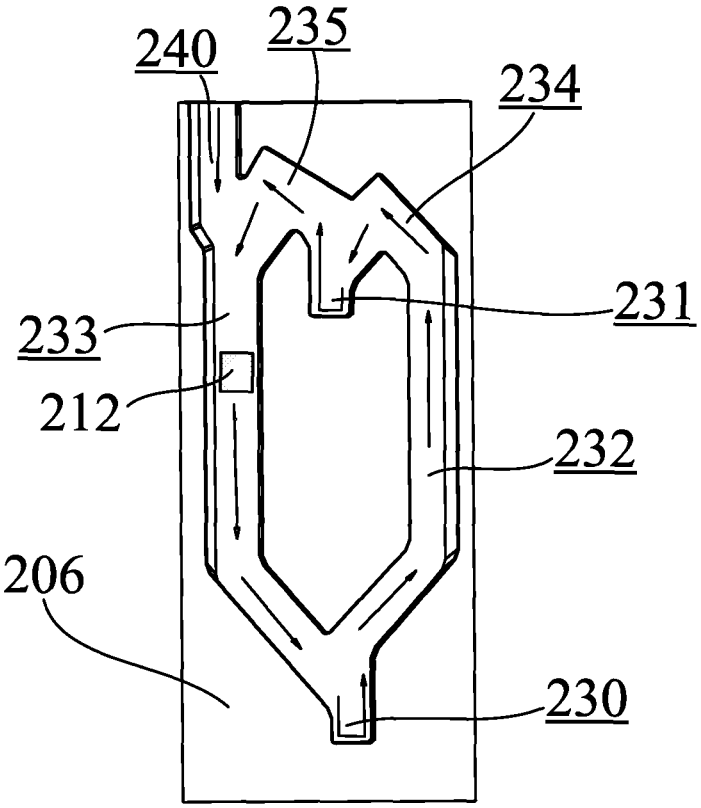
FIG. 10 is an enlarged side view of one of the linings shown in FIG. 9.

Referring to FIGS. 9 and 10, the track made in the external side of each of the linings 206 includes a lower longitudinal groove 230 and an upper longitudinal groove 231. The lower longitudinal groove 230 is connected to the upper longitudinal groove 231 via an upward groove 232, a downward groove 233, a first turning groove 234 and a second turning groove 235. A lower end of the upward groove 232 is connected to an upper end of the lower longitudinal groove 230. A lower end of the downward groove 233 is connected to the upper end of the lower longitudinal groove 230. The first turning groove 234 includes an end connected to an upper end of the upward groove 232 and another end is connected to an upper end of the upper longitudinal groove 231. The second turning groove 235 includes an end connected to an upper end of the downward groove 233 and another end connected to the upper end of the upper longitudinal groove 231. A port 240 is made at an upper end of the downward groove 233. One of the bosses 212 enters and leaves the track of one of the linings 206 via the port 240.

Referring to FIGS. 9 and 10, the movement of one of the bosses 212 in the track of one of the linings 206 will be described. In assembly, the boss 212 is inserted into the track via the port 240. The boss 212 is allowed to fall into the lower longitudinal groove 230 along the downward groove 233. Thus, the boss 212 is originally located in the lower longitudinal groove 230. The movable element 207 is lifted so that the boss 212 moves upwards and enters the upward groove 232, which is located above the lower longitudinal groove 230. The boss 212 continues to move upwards along the upward groove 232. The boss 212 enters the first turning groove 234 and continues to move upwards. The boss 212 reaches an upper limit of the first turning groove 234 and cannot move upwards any further. Then, the first turning groove 234 guides the boss 212 to move downwards and enter the upper longitudinal groove 231. The boss 212 would fall into the upper longitudinal groove 231 without an external force to lift the movable element 207. Now, the upward movement of the boss 212 into the upper longitudinal groove 231 from the lower longitudinal groove 230 is finished.

The downward movement of the boss 212 is similar to the upward movement. In the beginning of the downward movement, the boss 212 is located at the lower end of the upper longitudinal groove 231. The movable element 207 is lifted so that the boss 212 moves upwards into the second turning groove 235 from the lower end of the upper longitudinal groove 231. The boss 212 reaches an upper limit of the second turning groove 235 and cannot continue to move upwards. The second turning groove 235 guides the boss 212 to move downwards and enter the downward groove 233. The boss 212 moves downwards along the downward groove 233. Finally, the boss 212 reaches the lower end of the lower longitudinal groove 230 from the upper end of the lower longitudinal groove 230.

The boss 212 will move out of the track via the port 240, which is located at the upper end of the downward groove 233 if the movable element 207 is lifted during the downward movement of the boss 212 along the downward groove 233. The movable element 207 is movably connected to the stationary element 205 via the boss 212 formed on the internal side thereof so that the movable element 207 is detached from the stationary element 205 after the boss 212 moves out of the track of the lining 206 via the port 240. the port 240 enables the movable element 207 to be detachably connected to the movable element 205. Thus, the movable element 207 can be detached from the movable element 205 without using any tool, and the movable element 207 and the movable element 205 can be washed.

Referring to FIGS. 7 and 8, the axle 210 is connected to an upper end of the movable element 207. The axle 210 is inserted in a bore made in the upper end of the movable element 207 via an upper bushing 209 and a lower bushing 208. A mop head connector 211 is connected to an upper end of the axle 210.

Figure 11:
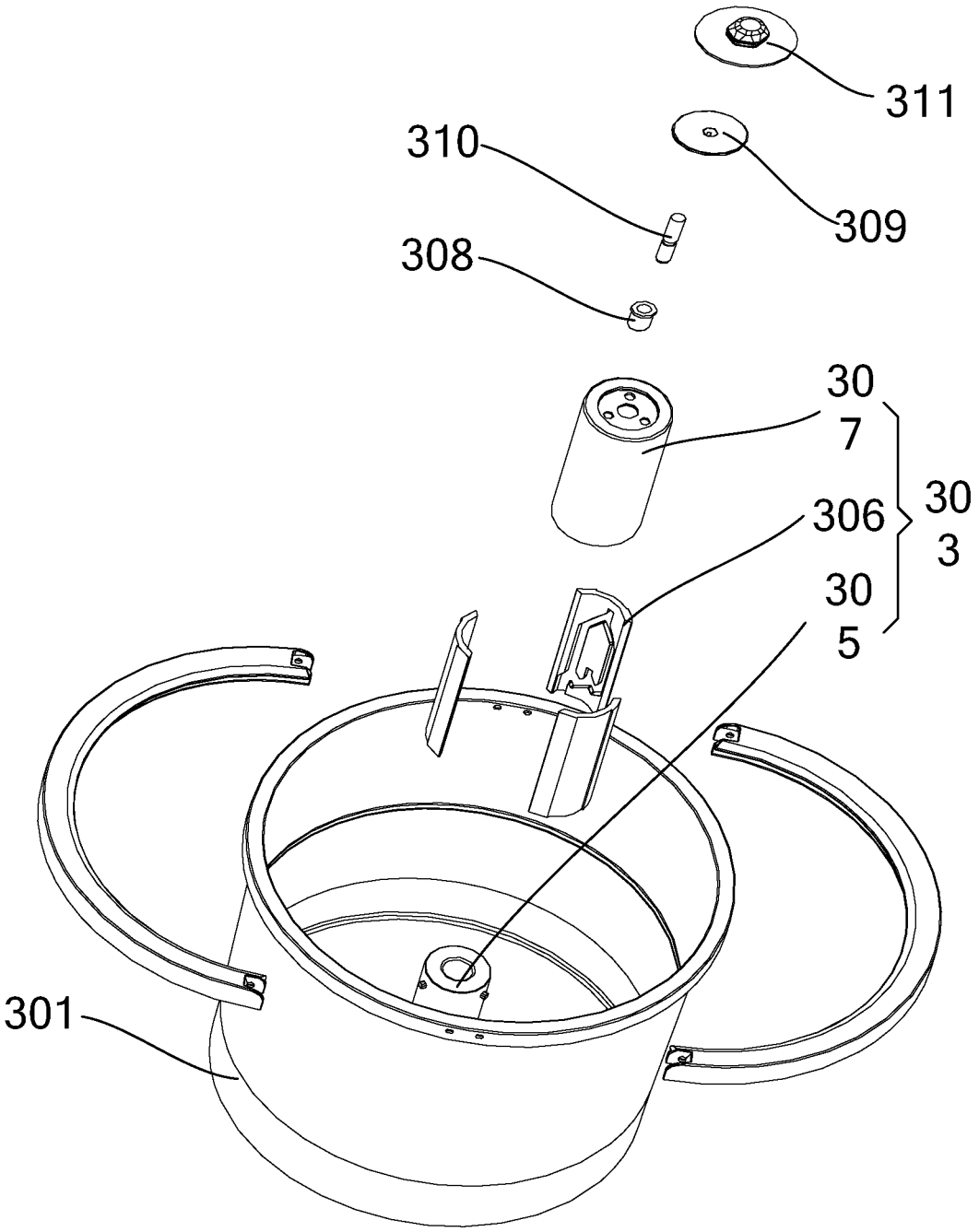
FIG. 11 is an exploded view of a mop-washing bucket equipped with an extensible post according to the third embodiment of the present invention.
Figure 12:
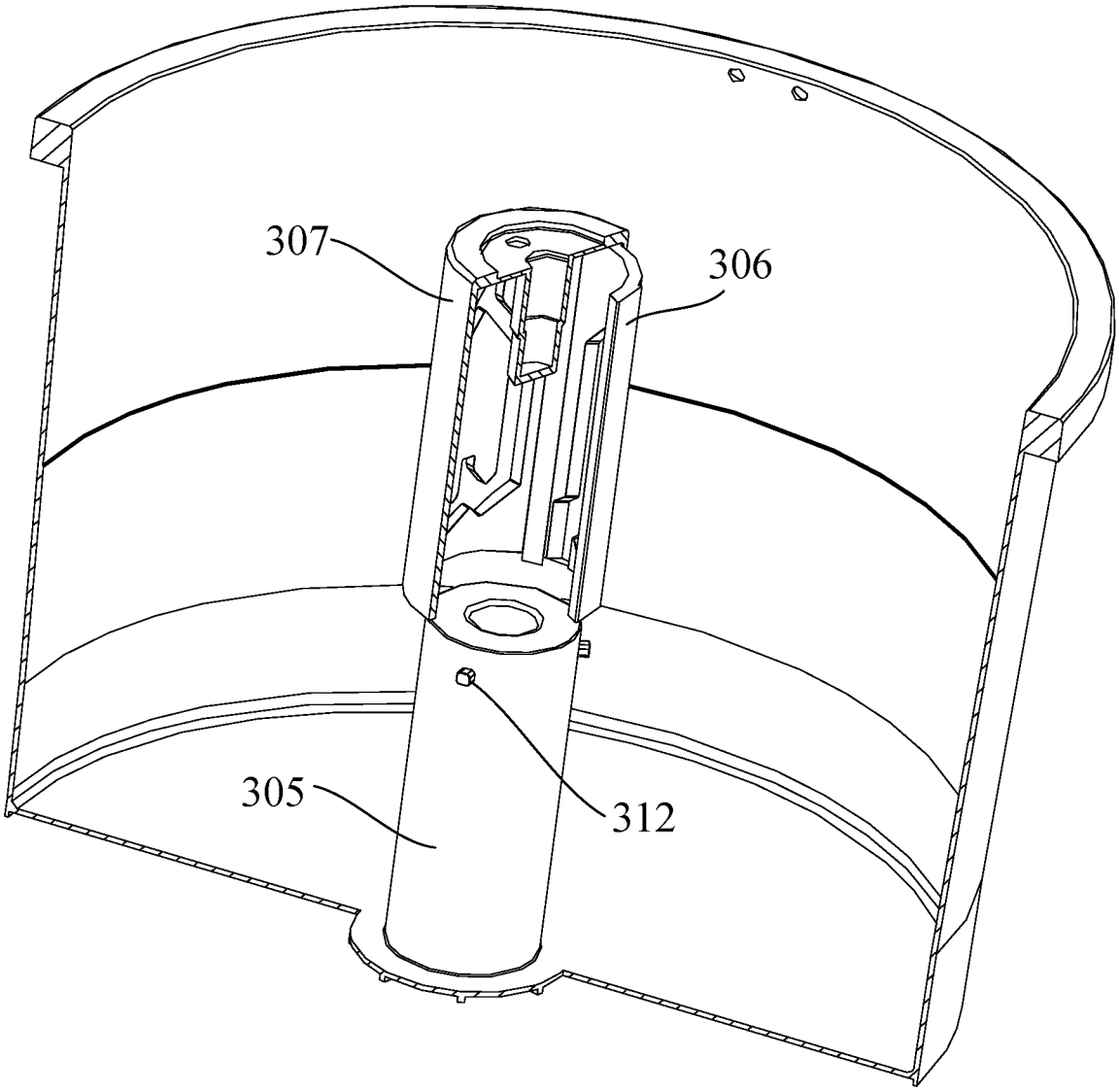
FIG. 12 is an enlarged cut-away view of the mop-washing bucket and the extensible post shown in FIG. 11.

Referring to FIGS. 11 and 12, there is a mop-cleaning apparatus according to a third embodiment of the present invention. An extensible post 303 includes a stationary element 305, three linings 306 and a movable element 307. A lower end of the stationary element 305 is secured to an internal side of a lower portion of the bucket 301. Three bosses 312 are formed on an internal side of an upper portion of the stationary element 305. The movable element 307 is a tubular element that includes a cavity made in an internal side. The linings 306 are inserted in the cavity of the movable element 307. There are three linings 306. Each of the linings 306 includes a track made in an internal side. The stationary element 305 is inserted in the movable element 307. The stationary element 305 includes, on an external side, three bosses 312 movably inserted in the tracks of the linings 306. As the movable element 307 is moved up and down, the bosses 312 move in the tracks made in the internal side of the linings 306.

Figure 13:
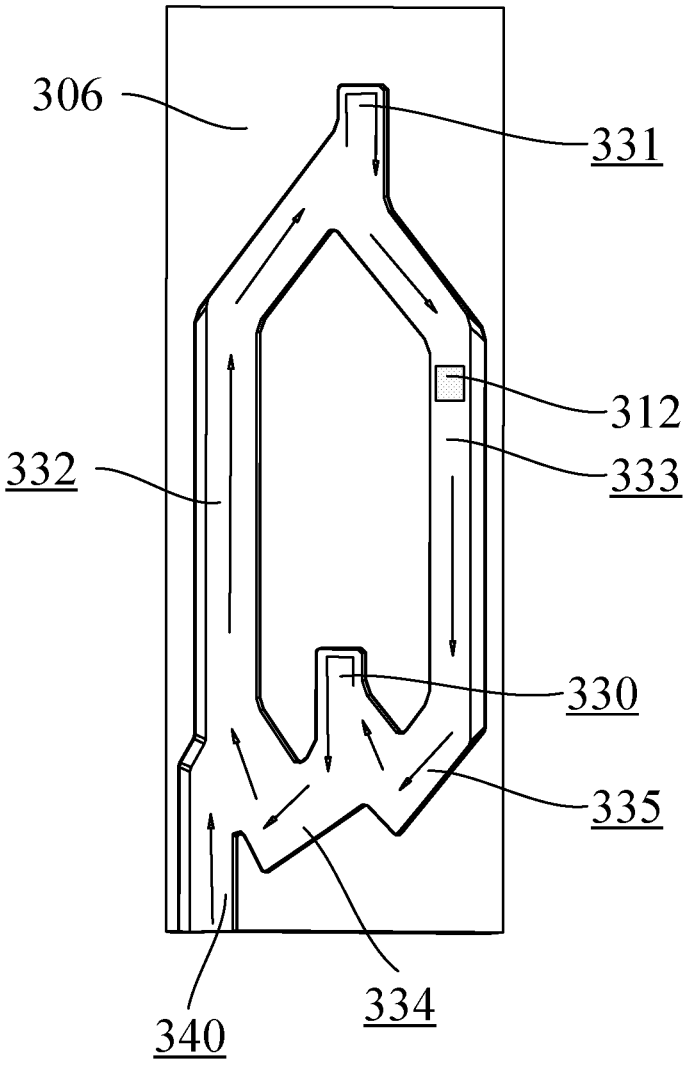
FIG. 13 is an enlarged side view of a lining of the extensible post shown in FIG. 11.

Referring to FIGS. 12 and 13, a mop-cleaning apparatus includes three linings 306 according to a third embodiment of the present invention. Each of the linings 306 includes a track on an internal side. The track includes a lower longitudinal groove 330 and an upper longitudinal groove 331. The lower longitudinal groove 330 is connected to the upper longitudinal groove 331 via an upward groove 332, a downward groove 333, a first turning groove 334 and a second turning groove 335. An upper end of the upward groove 332 is connected to a lower end of the upper longitudinal groove 331. An upper end of the downward groove 333 is connected to a lower end of the upper longitudinal groove 331. The first turning groove 334 includes an end connected to a lower end of the upward groove 332 and another end connected to a lower end of the lower longitudinal groove 330. The second turning groove 335 includes an end connected to a lower end of the downward groove 333 and another end connected to the lower end of the lower longitudinal groove 330. A port 340 is made at the lower end of the upward groove 332. A boss 312 can enter and leave the track via the port 340.

Referring to FIGS. 12 and 13, movement of the boss 312 in the track of one of the linings 306 will be described. In assembly, the boss 312 is inserted into the track of the lining 306 via the port 340 and lifted into the upper longitudinal groove 331 along the upward groove 332. Hence, the boss 312 is originally located in the upper longitudinal groove 331. Then, the movable element 307 is lifted so that the boss 312 enters the downward groove 333, which is located below the upper longitudinal groove 331. The boss 312 continues to move downwards along the downward groove 333. The boss 312 enters the second turning groove 335 and continues to move downwards. The boss 312 reaches a lower limit of the second turning groove 335 and cannot continue to move downwards. The boss 312 moves upwards from the lower limit of the second turning groove 335. The boss 312 enters the lower longitudinal groove 330 from the lower end of the lower longitudinal groove 330. The boss 312 would move upwards and reaches the upper end of the lower longitudinal groove 330 without an external force for lifting the movable element 307. Now, the downward movement of the boss 312 into the lower longitudinal groove 330 from the upper longitudinal groove 331 is finished.

The upward movement of the boss 312 is like the downward movement. The movable element 307 is lifted so that the boss 312 moves downwards relative to the track of the lining 306. The boss 312 moves downwards into the first turning groove 334, which is connected to the lower end of the lower longitudinal groove 330. The boss 312 reaches a lower limit of the first turning groove 334 and cannot move further downwards. The first turning groove 334 guides the boss 312 to move upwards and enter the upward groove 332. The boss 312 moves upward along the upward groove 332. Finally, the boss 312 enters the upper longitudinal groove 331 via the lower end of upper longitudinal groove 331.

If the movable element 307 is lifted during the upward movement of the boss 312 along the upward groove 332, the boss 312 will move downwards relative to the track of the lining 306. The boss 312 will leave the track of the lining 306 via the port 340, which is connected to the lower end of the upward groove 332. The stationary element 305 is movably connected to the movable element 307 via the boss 312 so that the stationary element 305 is detached from the movable element 307 after the boss 312 leaves the track of the lining 306.

According to FIG. 11, an axle 310 is connected to an upper end of the movable element 307. The axle 310 is inserted in a bore made in the upper end of the movable element 307 via an upper bushing 309 and a lower bushing 308. A mop head connector 311 is connected to an upper end of the axle 310.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A mop-cleaning apparatus for use in connection with a bucket and a mop, the mop-cleaning apparatus comprising:

an extendable post, wherein a first end of the extendable post is configured to couple with an internal side of a lower portion of the bucket and a second end of the extendable post is configured to attach to the mop, wherein the extendable post comprises:

a base element having an elongated dimension;

an extendable element coupled with the base element, the extendable element movable with respect to the stationary element along the elongated dimension;

at least one track disposed on the internal surface of one of the base element and the extendable element, wherein the track includes a lower longitudinal groove and an upper longitudinal groove connected to the lower longitudinal grove, wherein the external surface of the other one of the base element and the extendable element comprises at least one protrusion configured to fit within the at least one track to allow the extendable element to move with respect to the base element; and an axle connected to the second end of the extendable element and configured to receive the mop.

2. The mop-cleaning apparatus of claim 1, wherein the extendable element comprises a bore disposed approximate around the second end thereof, a lower bushing disposed within the bore, and an upper bushing disposed within the bore, wherein the axle is at least partially disposed within the upper and lower bushings.

3. The mop-cleaning apparatus of claim 1, wherein the base element is a tubular element, wherein the at least one track is disposed on an internal side of the base element, the at least one protrusion is disposed on an external side of a lower portion of the extendable element, and wherein the extendable element is at least partially disposed within the base element.

4. The mop-cleaning apparatus of claim 1, wherein the extendable element is a tubular element, wherein the at least one track is disposed on an external side of the base element, wherein the at least one protrusion is disposed on an internal side of a lower portion of the extendable element, and wherein the base element is at least partially disposed within the extendable element.

5. The mop-cleaning apparatus of claim 1, wherein the extendable element is a tubular element, wherein the at least one track is disposed on an internal side of the extendable element, the at least one protrusion is disposed on an upper portion of the base element, and wherein the base element is at least partially disposed within the extendable element.

6. The mop-cleaning apparatus of claim 1, wherein the at least one track further includes an annular groove for connecting the lower longitudinal groove to the upper longitudinal groove, and each of the lower and upper longitudinal grooves includes a slope formed at an upper end.

7. The mop-cleaning apparatus of claim 1, wherein the at least one track further comprises an upward groove, a downward groove, a first turning groove and a second turning groove, wherein the upward groove comprises a lower end connected to an upper end of the lower longitudinal groove, wherein the downward groove comprises a lower end connected to the upper end of the lower longitudinal groove, wherein the first turning groove comprises an end connected to an upper end of the upward groove and another end connected to an upper end of the upper longitudinal groove, and wherein the second turning groove includes an end connected to an upper end of the downward groove and another end connected to the upper end of the upper longitudinal groove.

8. The mop-cleaning apparatus of claim 7, wherein the at least one track further comprises a port connected to the upper end of the downward groove.

9. The mop-cleaning apparatus of claim 1, wherein the at least one track further comprises an upward groove, a downward groove, a first turning groove and a second turning groove, wherein the downward groove comprises an upper end connected to a lower end of the upper longitudinal groove, wherein the upward groove comprises an upper end connected to the lower end of the upper longitudinal groove, wherein the first turning groove comprises an end connected to a lower end of the upward groove and another end connected to a lower end of the lower longitudinal groove, and wherein the second turning groove includes an end connected to a lower end of the downward groove and another end connected to the lower end of the upper longitudinal groove.

10. The mop-cleaning apparatus of claim 1, wherein the at least one track comprises a number of lower longitudinal grooves and an identical number of upper longitudinal grooves.

11. The mop-cleaning apparatus of claim 1, further in combination with a mop comprising a mop head made with a cavity and claws configured to couple the mop with the axle.

12. The mop-cleaning apparatus of claim 1, wherein the extendable post further comprises a mechanism disposed at the first end and configured to attach the extendable post to an external surface.

* * * * *